US005289785A

United States Patent [19]

MacPherson et al.

[11] Patent Number: 5,289,785

[45] Date of Patent: Mar. 1, 1994

[54] SECURITY ENCLOSURES

[75] Inventors: Hugh MacPherson, Fife; Eileen Greenshields, South Queensferry; John MacSween, Glasgow, all of Scotland

[73] Assignee: W. L. Gore & Associates (UK) Ltd., London, United Kingdom

[21] Appl. No.: 900,866

[22] Filed: Jun. 18, 1992

[30] Foreign Application Priority Data

Jun. 21, 1991 [GB] United Kingdom ..... 9113437

[51] Int. Cl.[5] ..... G08B 13/00

[52] U.S. Cl. ..... 109/42; 340/550; 428/915; 428/916; 206/459.1; 206/807; 109/38

[58] Field of Search ..... 109/31-38, 109/40, 41, 42, 49.5; 340/550; 361/398; 428/915, 916; 206/459.1, 807; 247/98

[56] References Cited

U.S. PATENT DOCUMENTS

| | | | |
|---|---|---|---|
| 3,594,770 | 7/1971 | Ham | 174/261 |
| 3,623,944 | 11/1971 | Davis | 428/915 |
| 3,925,584 | 12/1975 | Suzuki et al. | 428/915 |
| 4,749,084 | 6/1988 | Pereyra | 206/459.1 |
| 4,754,629 | 7/1988 | Allen | 70/333 R |
| 4,882,216 | 11/1989 | Takimoto et al. | 361/397 |
| 4,894,271 | 1/1990 | Hani et al. | 361/397 |
| 4,910,045 | 3/1990 | Giesecke et al. | 427/98 |
| 4,954,185 | 9/1990 | Kohm | 148/282 |
| 4,972,175 | 11/1990 | MacPherson | 340/550 |
| 4,985,294 | 1/1991 | Watanabe et al. | 361/397 |

FOREIGN PATENT DOCUMENTS

| | | | |
|---|---|---|---|
| 8300246 | 1/1983 | PCT Int'l Appl. | 340/550 |
| 2245738 | 1/1992 | United Kingdom | 340/550 |

*Primary Examiner*—Peter M. Cuomo
*Assistant Examiner*—Darnell M. Boucher

[57] ABSTRACT

A security enclosure comprises a first layer of an insulating material extending over the whole of the area of the enclosure and carrying a linear electrically responsive element on at least one surface. A low tensile strength layer having lower cohesion than adhesion is located between the first layer of insulating material and the electrically responsive element. A second layer of insulating material is adhered to and covers the electrically responsive element. The element is arranged in a configuration on the surface so dividing the surface that attempted penetration of the enclosure changes an electrical characteristic of the element, the change being detectable by an electrical circuit. An attempt to remove the second layer of insulating material to gain access to the element results in breakup of the low tensile strength layer and thus damage to the element and produces a detectable change in an electrical characteristic of the element.

14 Claims, 3 Drawing Sheets

SECURITY ENCLOSURES

FIELD OF INVENTION

This invention relates to improvements in security enclosures, and in particular to security enclosures provided with protected laminated walls. The invention also relates to sheets and laminates for use in making such enclosures.

BACKGROUND OF THE INVENTION

Security enclosures may be used in the protection of items in transit or storage such as documents or magnetic information, and may be used to contain components to which it is desired to restrict access, such as electronic circuits containing memory information. Documents and magnetic files containing security sensitive information have to be sent throughout the world and it is often necessary to ensure that the documents have not been interfered with in transit or that if any attempt is made to reveal the information by an unauthorised person an alarm is sounded and the information destroyed or erased. Printed circuit boards, computers and data conversion equipment often contain memory devices which must be secured against unauthorised access. Any attempt to access or tap onto the board or device should ideally result in erasure of any memory information.

The enclosure should provide protection from many forms of attack, from very crude destructive attacks to highly sophisticated laboratory attacks, but at the same time be sufficiently insensitive as not to be triggered by normal environmental effects such as temperature, humidity and vibration. Such a security enclosure is described in U.K. patent application GB 2220513A to W. L. Gore & Associates Inc. The disclosed enclosure is formed from layers of flexible material. One layer carries flexible semi-conductive lines arranged to extend over the whole area of the enclosure. Any interruption of the lines by unauthorised opening of the enclosure changes the resistance of the line and so may be detected by a monitoring circuit. Also, two layers of semi-conductive fibers cover the whole area of the enclosure and are separated by an insulating layer. The length of the fibres forming the layers is of greater than the thickness of the insulating layer so that if the enclosure is pierced fibres from one layer will be forced into contact with fibres from the other layer. This will change the combined resistance of the layers and this may also be detected by the monitoring circuit. In the embodiment disclosed in this application, the layer carrying the flexible semi-conductive lines forms the second outermost layer of the enclosure, being covered by a further insulating layer of polyester.

One method of penetrating the disclosed enclosure would involve isolating selected flexible semi-conductive lines so that they could be cut through without the breaks in the lines being detected by the monitoring circuit. To gain the necessary access to the semi-conductive lines it would be necessary to peel back selected areas of the outer insulating layer.

A further form of security enclosure, in the form of a container, is disclosed in British Patent No. 1375926 to GAO Gesellschaft Fur Automation und Organisation mbH. The inside faces of the walls of the disclosed container are lined with an insulating foil on which conductors may be deposited by evaporation or by etching. The conductors are monitored by measuring the currents flowing in the conductors, a change in current indicating interference with the container. A plurality of foils may be glued on to one another and the adhesion of a conductor web on the foil is less than the adhesion which is produced when one foil is glued on to the other with a particular adhesive. As a result, when one foil is separated, the conductor web on the other foil may be positively torn away.

SUMMARY OF THE INVENTION

According to one aspect of the present invention there is provided a security enclosure comprising a first layer of an insulating material extending over the whole of the area of the enclosure and carrying a linear electrically responsive element on at least one surface. A low tensile strength layer having lower cohesion than adhesion is located between the first layer of insulating material and the electrically responsive element. A second layer of insulating material is adhered to and covers the electrically responsive element. The element is arranged in a configuration on the surface so dividing the surface that attempted penetration of the enclosure changes an electrical characteristic of the element, the change being detectable by an electrical circuit. An attempt to remove the second layer of insulating material to gain access to the element results in breakup of the low tensile strength layer and thus damage to the element and produces a detectable change in an electrical characteristic of the element.

Preferably, the materials used to form the layers are flexible to allow the laminate formed by the layers to be folded and creased.

Preferably also, the linear electrically responsive element is formed of a carrier filled with conductive material, and most preferably a first polymer filled with carbon or graphite. The low tensile strength layer may be a second polymer and the adhesive used to adhere the second layer of insulating material to the element a third polymer. The various polymers are selected to minimise migration of conductive material from the first polymer to the second and third polymers.

According to a further aspect of the present invention there is provided a laminate for use in forming a security enclosure, comprising a first layer of an insulating material carrying a linear electrically responsive element on at least one surface. A layer of low tensile strength material having lower cohesion than adhesion is located between the first layer of insulating material and the electrically responsive element. A second layer of insulating material is adhered to and covers the electrically responsive element. The element is arranged in a configuration on the surface so dividing the surface that attempted penetration of the laminate changes an electrical characteristic of the element, which change may be detected by an appropriate electrical circuit. Attempts to remove the second layer of insulating material to gain access to the linear electrically responsive element will result in breakup of the low tensile strength layer and thus damage to the element and produce a detectable change in an electrical characteristic of the element.

According to a still further aspect of the present invention there is provided a security enclosure comprising a flexible laminate which is folded and joined at overlapping edge portions to define the enclosure, the laminate comprising a flexible first layer of insulating material extending over the whole of the area of the enclosure and carrying lines of electrically responsive material on one side. A further layer of insulating material is adhered to and cover the lines, though the lines at at least one of the overlapping edges of the laminate are exposed beyond an adjacent edge of the insulating layer. The lines are arranged in a configuration on the surface so dividing the laminate that attempted penetration of the enclosure changes an electrical characteristic of the lines. Means are provided for detecting such changes in the electrical characteristics of the lines. A layer of low tensile strength material is provided between the first layer of insulating material and the lines of electrically responsive material at said at least one of the overlapping edges. The low tensile strength material has lower cohesion than adhesion and any attempt to separate the overlapping edges to gain access to the enclosure results in breakup of the low tensile strength layer and damage to the lines producing a detectable change in an electrical characteristic of the lines.

BRIEF DESCRIPTION OF THE DRAWINGS

These and other aspects of the present invention will now be described, by way of example, with reference to the accompanying drawings in which.

DETAILED DESCRIPTION OF DRAWINGS

Figure 1:
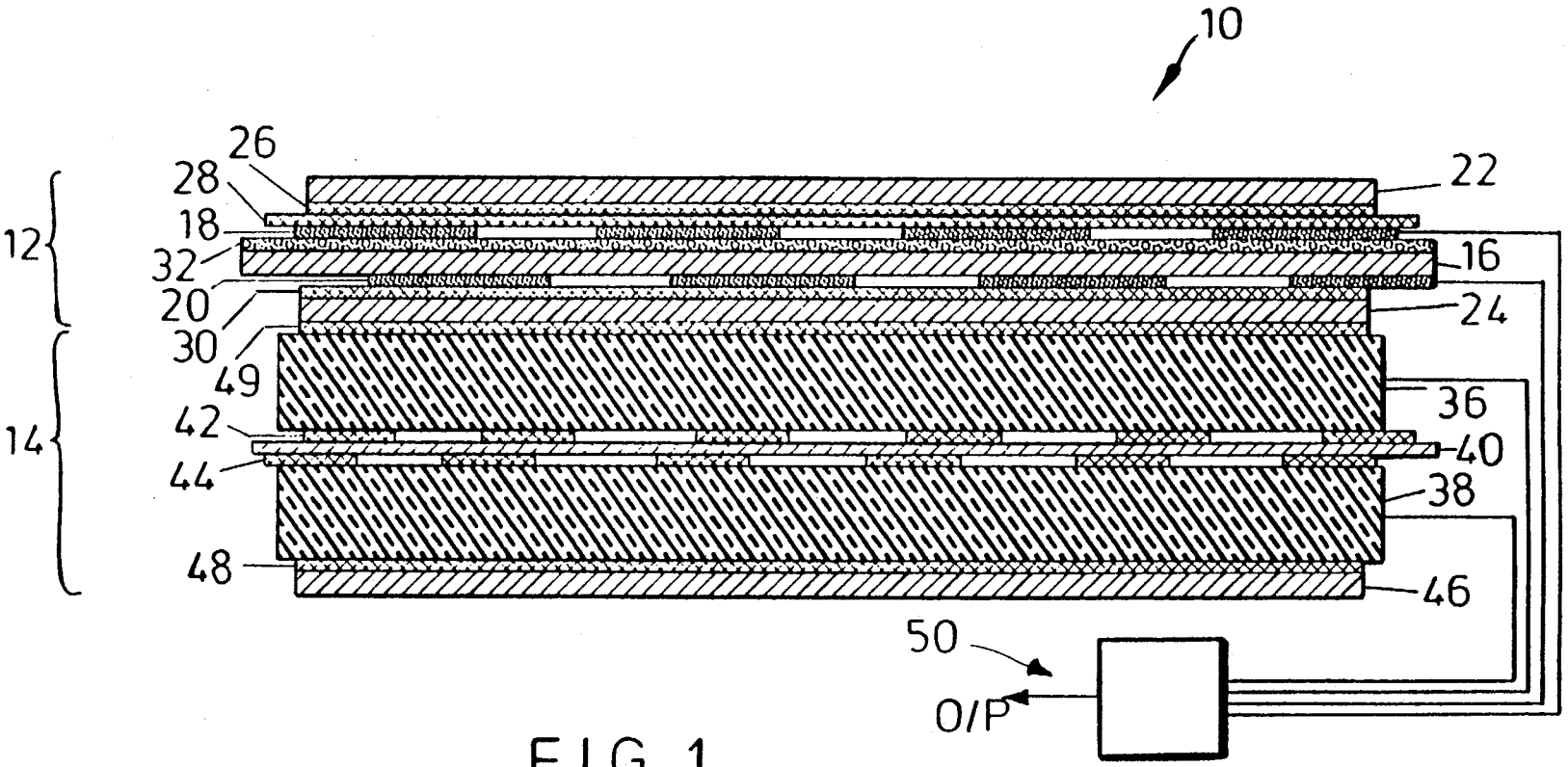
FIG. 1 is a sectional view of a laminate for use in forming an enclosure, in accordance with a first preferred embodiment of the present invention.

Reference is first made to FIG. 1 of the drawings which illustrates a laminate 10 in accordance with a first preferred embodiment of the present invention. The laminate 10 is intended for use in forming security enclosures, such as described in the abovementioned U.K. patent application No. 2220513A.

The laminate 10 comprises various layers which are intended to provide an indication if any attempt is made to penetrate the laminate in order to gain access to material or objects contained within an enclosure formed using the laminate.

The laminate 10 can be thought of as comprising two portions 12, 14 and the present invention relates to improvements to the upper portion 12 (as seen in FIG. 1), while the lower portion 14 is similar to the corresponding portion of the laminate described in the above mentioned U.K. patent application. The upper portion 12 comprises a flexible sheet of insulating material which will normally be provided in the form of a thin insulating film 16. Lines 18, 20 of electrically responsive material, preferably semi-conductive material are printed on both sides of the film 16. The lines 18, 20 preferably extend diagonally over the film 16 and are formed of semi-conductive ink, most preferably comprising a matrix of low molecular weight polyester resin filled with carbon and graphite. Typically each line may be formed with a resistivity of 6 ohms - cm for 25% carbon loading in polyester and is applied by screen printing to a dry thickness of approximately 10 microns. The lines 18, 20 are connected (connection not shown) at the edges of the film 16 to form a single conductor, such as described in the above mentioned U.K. patent application, or plurality of conductors, as described in applicants copending patent application also entitled Improvements in Security Enclosures, as filed concurrently herewith. Typically, the lines 18, 20 are spaced to produce a matrix of diamond shaped areas of no larger dimensions than 10 millimeters, The matrix of lines 18, 20 forms a continually connected circuit which will be broken if attempts are made to penetrate the film by cutting, abrasion, application of solvent, or application of heat. To further protect the lines 18, 20, second and third layers of insulating material in the form of films 22, 24 are adhered to and cover the respective lines. When the laminate 10 is formed into an enclosure, the second insulating film 22 will form the outer surface of the enclosure.

The insulating films 22, 24 are secured by means of layers 26, 28, 30 of adhesive, as will be described in more detail. It will also be noted that there is a further layer 32 between the insulating film 16 and the semi-conductive lines 18, which will also be described in more detail.

The second portion 14 of the laminate comprises two layers 36, 38 of semi-conductive fibrous material separated by a layer 40 of thin insulating film. Each semi-conductive layer 36, 38 is made throughout of fibrous material such that, in use, if a sharp object penetrates the layers, the object will pull fragments of the upper semi-conductive layer 36 through the intervening insulating layer 40 to touch, and make electrical contact with, the lower semi-conductive layer 38. In order to have a high probability of a conductive path being formed, the insulating layer should be thinner than the length of the conductive fibers produced by pushing an object through one of the semi-conductive layers 36, 38. The insulating layer 40 should therefore be no thicker than, and preferably is thinner than, the semi-conductive layers 36, 38. The preferred semi-conductive fibrous material is low densified conductive polytetrafluoroethylene (PTFE) having a volume resistivity typically from 1 to 10 ohms - cm and the preferred insulating material is polyester film, around 12 microns thick.

FIG. 1 also shows patterned adhesive layers 42, 44 between the insulating film layer 40 and the semi-conductive fibrous layers 36, 38. A further, somewhat thicker insulating film layer 46, around 23 microns thick, is adhered to the innermost semi-conductive fibrous layer 38, using adhesive 48.

The two portions 12, 14 are joined together by means of a layer of adhesive 49.

The laminate 10 may be folded or formed into an enclosure and various ones of the layers of the laminate are connected to means for detecting changes in the electrical characteristics of the layers, in the form of a monitoring device 50. Various forms of monitoring devices may be used depending on the application, suitable devices being described in the abovementioned U.K. patent applications. The device 50 will typically maintain the lines 18, 20 and semi-conductive layers 36, 38 at reference potentials. Thus, any break or damage to the lines 18, 20 caused by penetration of the upper portion 12 will result in a detectable change in the potential of the lines. Similarly, penetration of the semi-conductive fibrous layers 26, 38 by an object will result in electrical connection between the layers and thus also produce a detectable change in the potential of the layers 36, 38. On detecting an attempt to penetrate the enclosure the monitoring device 50 produces an output signal which may, for example, activate an alarm or destroy or erase information contained in or on objects contained within the enclosure.

An unauthorized entry to the enclosure may include an attempt to separate the layers of the laminate, and in particular to separate the layers to reveal the semi-conductive lines 18, 20 so that, for example, attempts can be made to isolate particular lines from the monitoring device 50 to allow them to be cut through or removed. This would typically involve an attempt to peel back the outermost insulating film 22 and it is to this method of gaining entry that this invention particularly relates.

Before the lines 18, 20 are printed on the insulating film 16, a low tensile strength layer 32 having lower cohesion than adhesion is printed on at least the top side of the film 16. Preferably the material for the layer has considerably lower cohesion than adhesion. The layer 32 may comprise an ethylvinyl acetate (EVA) having high vinyl acetate (VA) content, for example 70% VA, also filled to 45%-60% (by weight EVA with fumed silica (typically having particle size of 12 nm and 20 $m^2/g$ surface area). It is also preferred that the material contains a black pigment such that the carbon loaded semi-conductive lines 18 are not easily visible on the layer 32.

The adhesive layer 28, formed of pressure sensitive, heat reflowable adhesive, preferably a high VA content EVA, for example 70% of VA and also pigmented black, is printed over the lines 18 of at least the upper side of the film 16. The outer insulating film layer 22, which has been pre-coated with EVA, is laminated preferably at a temperature with range 60° to 80° C. to the adhesive 28 coating the lines 18. The two layers of adhesive 26, 28 become homogeneous after a time, typically one or two days.

The lines 18 are effectively sandwiched and supported between two layers of adhesive, in this particular example the adhesive layers 28,32 being of EVA and one being filled with fumed silica to reduce its tensile strength. In practise, the adhesive will flow to occupy the air gaps which may be seen between the lines 18 in the Figure. Also, it should be noted that the thickness of the adhesive layers shown in the Figures is somewhat exaggerated.

The materials which form the adhesive layers 26, 28 and the low tensile strength layer 32 and the matrix material of the lines 18 are selected such that the lines 28 and the other layers are chemically different such that only moderate carbon migration takes place from the lines 18 to the layers 26, 28, 30 and 32. Such migration results in a slight but acceptable rise in electrical resistance of the lines 18.

The resulting laminate is robust in normal use and may be folded and creased without track damage.

Figure 2:
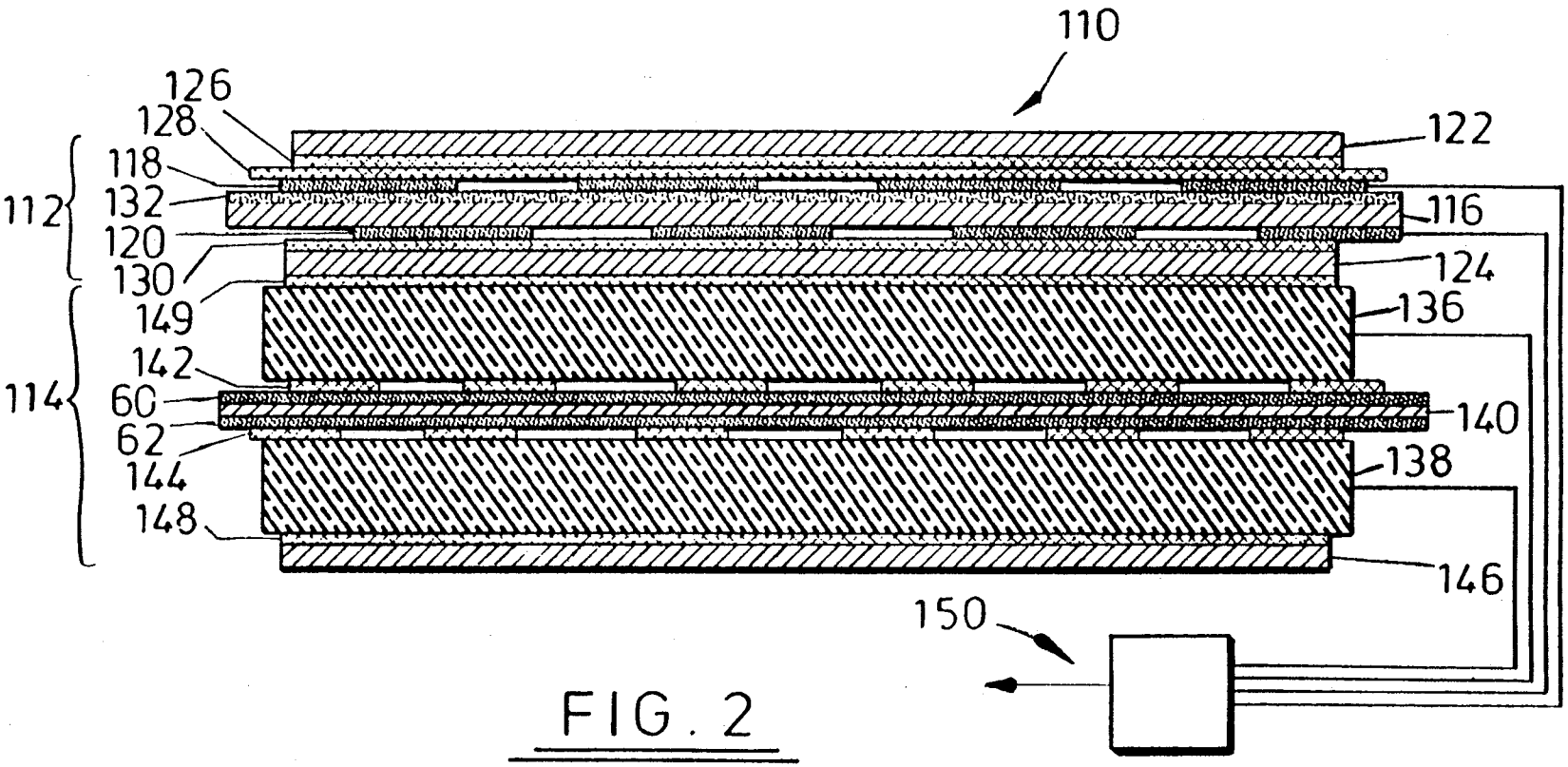
FIG. 2 is a sectional view of laminate for use in forming an enclosure, in accordance with a second preferred embodiment of the present invention.

Reference is now made to FIG. 2 of the drawings, which illustrates a laminate in accordance with a second preferred embodiment of the present invention. The laminate is substantially similar to the laminate that described with reference to FIG. 1 and to avoid repetition the similar features of the laminate of FIG. 2 will not be described again, similar reference numerals as appeared in FIG. 1 being used to indicate similar elements in FIG. 2, though prefixed with a 1 in FIG. 2.

The difference between the laminates 10, 110 lies in the provision of at least one layer of fusible material between the semi-conductive fibrous layers 136, 138. In this example the provision is of two layers 60, 62 of fusible material one on each side of the insulating layer 140 separating the layers 136, 138.

If an attempt is made to penetrate the laminate 110 using laser or other heat generating means the semi-conductive fusible or low melt material which forms the layers 60, 62 will melt and flow through any breaks in the insulating layer 140, to form an electrical connection between the semi-conductive layers 36, 38. This will of course affect the electrical characteristics of the layers 136, 138 and will be detected by the monitoring device 150. Details of such low melt materials are contained in our European Patent Application Serial No. 0459838.

Figure 3:
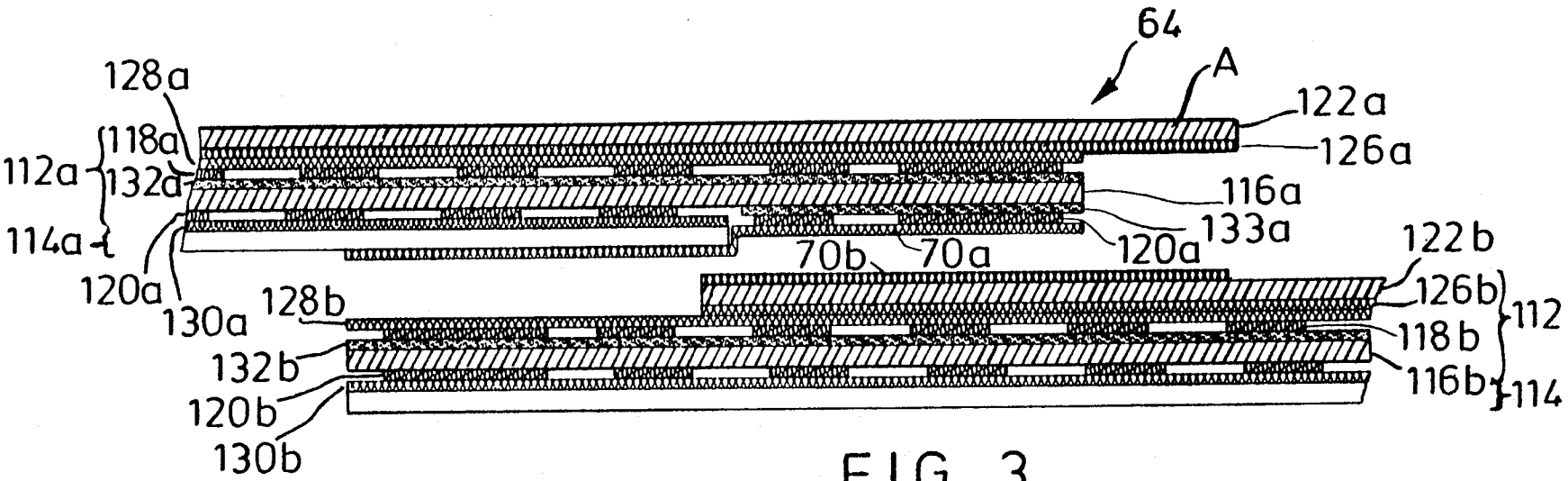
FIG. 3 is a sectional view of overlapping edge portions of the laminate of FIG. 2 adapted for joining to form an enclosure.
Figure 4:
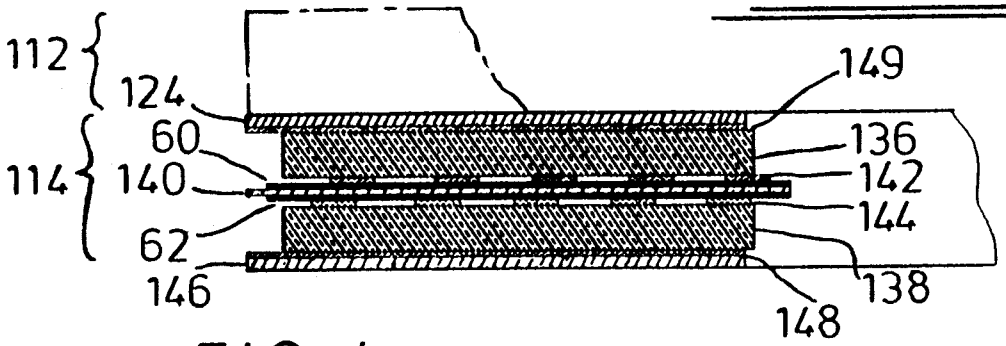
FIG. 4 is a sectional view of a part of an edge portion of the laminate of FIG. 3.

Reference is now made to FIGS. 3 and 4 of the drawings, which illustrate details of the overlapping edges of the laminate 110 which are joined to form an enclosure. It should be noted that in FIG. 3 the lower portion 114 has been "compressed" for clarity, but is shown in full in FIG. 4.

First referring to the edge portion 64 which form the upper overlapping edge as may be seen in FIG. 3, the upper insulating film **122*a* extends beyond the edge of the upper portion 112*a* to form a flap A. The underside of the flap A is provided with adhesive layer 126*a***, which is utilised to secure the flap A to the other edge portion.

The lower portion **114*a* does not extend to the edge of the upper portion 112*a* and at the "exposed" inner face of the portion 112*a*, an edge layer of low tensile strength material 133*a* is provided below the conductive lines 120*a*. An additional layer of adhesive 70*a* is provided over the exposed lines 120*a* and continues over the edge of the inner face of the lower portion 114*a***.

On the lower overlapping edge, the upper insulating film **122*b* does not extend to the edge of the laminate, leaving a portion of the adhesive layer 128*b* exposed. A further layer of adhesive 70*b* is provided on the edge of the film 122*b***.

Now referring to FIG. 4, which illustrates the edge configuration of the lower portion 114 for forming both upper and lower overlapping parts, it will be noted that the various insulating layers 124, 140, 146 are simply extended relative to the semi-conductive layers 136, 138 to ensure there is no contact between the layers 136, 138 at the edges.

The edges of the laminate are brought together in the relative overlapping positions shown in FIG. 3 and the various layers of adhesive **126*a*, 70*a*, 128*b*, 70*b* which come into contact become homogeneous over a period of time to provide a secure join. If any attempt is made to separate the edges, as the outer insulating film 122*a*, or any of the other layers is peeled back, one or more of the low tensile strength layers 132*a*, 133*a*, 132*b* will fragment, breaking the lines 118*a*, 120*a*, 118*b***.

Thus the above described embodiments of the present invention provide laminates and thus enclosures with mechanical and electrical stability under normal working conditions, but which will readily detect any attempted delamination of the outer protective layer or attempts to slit the laminate with a sharp instrument.

It will be clear to those of skill in the art that the above described embodiments are merely exemplary of the present invention, and that various modifications and improvements may be made to the invention without departing from the scope and spirit of the invention.

We claim:

1. A security enclosure comprising a first layer of an insulating material extending over the whole of the area of the enclosure and carrying a linear electrically responsive element on at least one surface thereof, a low tensile strength layer having lower cohesion than adhesion located between the first layer of insulating material and the electrically responsive element and a second layer of insulating material adhered to and covering the electrically responsive element, the element being arranged in a configuration on the surface of the first layer so dividing the surface that attempted penetration of the enclosure changes an electrical characteristic of the element, and detection means being provided for detecting said change, an attempt to remove the second layer of insulating material to gain access to the element resulting in breakup of the low tensile strength layer and thus damaging the element to produce a detectable change in said electrical characteristic of the element.

2. The security enclosure of claim 1 wherein the first and second layers, the low tensile strength layer and the electrically responsive element are flexible to allow the laminate to be folded and creased.

3. The security enclosure of claim 1 wherein the linear electrically responsive element is a carrier filled with conductive material.

4. The security enclosure of claim 3 wherein the linear electrically responsive element is a matrix of a first polymer filled with carbon or graphite.

5. The security enclosure of claim 4 wherein: the low tensile strength layer is a second polymer; and an adhesive layer is provided between the second layer of insulating material and the element in the form of a third polymer, and said polymers are selected to minimize migration of conductive material from the first polymer to the second and third polymers.

6. The security enclosure of claim 3 wherein the electrically responsive element is a semi-conductive ink comprising a matrix of low molecular weight polyester resin filled with carbon and graphite.

7. The security enclosure of claim 1 wherein the low tensile strength layer is a matrix of a polymer filled with granular material.

8. The security enclosure of claim 7 wherein the low tensile strength layer is an ethyl vinyl acetate having high vinyl acetate content and filled to 45% to 60% by weight of fumed silica.

9. The security enclosure of claim 1 wherein the other surface of the first layer of insulating material carries a further linear electrically responsive element and a third layer of insulating material is adhered to and covers the further element, the electrically responsive elements being in the form of lines and the lines on one side of the first layer extending obliquely relative to the lines on the other side and being connected thereto at edge portions of the first layer to form at least one conductor so dividing the first layer into a number of relatively small areas that attempted penetration of the enclosure changes an electrical characteristic of said at least one conductor.

10. The security enclosure of claim 9 wherein the layers define a laminate which is folded and joined at overlapping edge portions to define the enclosure and the lines at at least one of the overlapping edges of the laminate are exposed beyond an adjacent edge of the respective insulating layer, and a layer of low tensile strength material is provided between the first layer of insulating material and the lines of electrically responsive material at said at least one of the overlapping edges so that any attempt to separate the overlapping edges to gain access to the enclosure results and breakup of the low tensile strength layer and damage to the lines.

11. The security enclosure of claim 1 wherein the linear electrically response element has low tensile strength, and wherein breakup of the low tensile strength layer between the element and the first layer of insulating material results in breakup of the element.

12. The security enclosure of claim 1 wherein the first layer of insulating material is located internally of the second layer of insulating material.

13. A laminate for use in forming a security enclosure, the laminate comprising a first layer of an insulating material carrying a linear electrically responsive element on at least one surface thereof, a layer of low tensile strength material having lower cohesion than adhesion being located between the first layer of insulating material and the electrically responsive element a second layer of insulating material being adhered to and covering the electrically responsive element, the element being arranged in a configuration on the surface so dividing the surface that attempted penetration of the laminate changes an electrical characteristic of the element, which change may be detected by an appropriate electrical circuit and an attempt to remove the second layer of insulating material to gain access to the linear electrically responsive element will result in breakup of the low tensile strength layer and thus damage the element and produce a detectable change in said electrical characteristic of the element.

14. A security enclosure comprising a flexible laminate which is folded and joined at overlapping edge portions to define the enclosure, the laminate comprising a flexible first layer of insulating material extending over the whole of the area of the enclosure and carrying lines of electrically responsive material on one side thereof, a further layer of insulating material being adhered to and covering the lines with the lines at at least one of the overlapping edges of the laminate being exposed beyond and adjacent edge of the insulating layer, the lines being arranged in a configuration on the surface so dividing the laminate that attempted penetration of the enclosure changes an electrical characteristic of the lines, means being provided for detecting said changes in the electrical characteristics of the lines and a layer of low tensile strength material being provided between the first layer of insulating material and the lines of electrical responsive material at said at least one of the overlapping edges, the low tensile strength material having lower cohesion than adhesion and any attempt to separate the overlapping edges to gain access to the enclosure resulting in breakup of the low tensile strength layer and damage to the lines to produce said detectable change.

* * * * *